US008640494B2

(12) United States Patent
Lourenco et al.

(10) Patent No.: US 8,640,494 B2
(45) Date of Patent: Feb. 4, 2014

(54) METHOD TO PRODUCE NATURAL GAS LIQUIDS NGLS AT GAS PRESSURE REDUCTION STATIONS

(76) Inventors: Jose Lourenco, Edmonton (CA); MacKenzie Millar, Edmonton (CA)

( * ) Notice: Subject to any disclaimer, the term of this patent is extended or adjusted under 35 U.S.C. 154(b) by 950 days.

(21) Appl. No.: 12/121,486

(22) Filed: May 15, 2008

(65) Prior Publication Data

US 2009/0282863 A1 Nov. 19, 2009

(51) Int. Cl.
*F25J 3/00* (2006.01)
*F25J 1/00* (2006.01)

(52) U.S. Cl.
USPC ..... 62/618; 62/611; 62/619; 62/621

(58) Field of Classification Search
USPC ..... 62/618, 611, 621
See application file for complete search history.

(56) References Cited

U.S. PATENT DOCUMENTS 5,685,170 A * 11/1997 Sorensen ..... 62/625
6,131,407 A * 10/2000 Wissolik ..... 62/606
6,182,469 B1 * 2/2001 Campbell et al. ..... 62/621
6,526,777 B1 * 3/2003 Campbell et al. ..... 62/621
7,107,788 B2 * 9/2006 Patel et al. ..... 62/625
7,257,966 B2 * 8/2007 Lee et al. ..... 62/620
7,377,127 B2 * 5/2008 Mak ..... 62/630
2009/0113928 A1 * 5/2009 Vandor et al. ..... 62/612

* cited by examiner

*Primary Examiner* — Frantz Jules
*Assistant Examiner* — Keith Raymond
(74) *Attorney, Agent, or Firm* — Christensen O'Connor Johnson Kindness PLLC

(57) ABSTRACT

A method to recover NGL's at gas Pressure Reducing Stations. A first step involve providing at least one heat exchanger having a flow path for passage of high pressure natural gas with a counter current depressurized lean cold gas. A second step involves passing the high pressure natural gas stream in a counter current flow with the lean cold gas and cooling it before de-pressurization. A third step involves the expansion of the high pressure cooled gas in a gas expander. The expansion of the gas generates shaft work which is converted into electrical power by the power generator and the expanded low pressure and cold gas enters a separator where NGL's are recovered. This process results in the recovery NGL's, electricity and the displacement of a slipstream of natural that is presently used to pre-heat gas at Pressure Reduction Stations.

6 Claims, 5 Drawing Sheets

METHOD TO PRODUCE NATURAL GAS LIQUIDS NGLS AT GAS PRESSURE REDUCTION STATIONS

FIELD OF THE INVENTION

The present invention relates to a method of producing NGL's at gas Pressure Reduction Stations when the pressure is letdown from gas main transmission lines to local gas distribution lines.

BACKGROUND OF THE INVENTION

In gas Pressure Reduction Stations, the gas is pre-heated before the pressure is dropped to prevent the formation of hydrates which can cause damage to the pipeline and associated equipment. The typical pressure reduction varies between 400 to 900 PSIG (pounds per square inch gage) for main transmission gas lines to local distribution lines and from 50 to 95 PSIG from local distribution lines to consumers. When gas is depressurised the temperature drops. The rule of thumb is that for every 100 pounds of pressure drop across a pressure reducing valve the gas temperature will drop by 7 F. When the pressure is reduced by the use of an expander, the temperature drop is greater because it produces work. The heat required to prevent formation of hydrates is normally provided by hot water boilers, gas fired line heaters or waste heat from; gas turbines, gas engines or fuel cells. In some stations, due to its large volumetric flows and pressure drops, energy can be and is recovered, by a combination of gas expander and boiler. For a more efficient recovery, combinations of gas expanders with CHP processes (Combined Heat and Power) or CCHP (Combined Cooling Heat and Power) processes are possible. The limitation in these applications are the economics which are driven by flow volumes, pressure delta, seasonal volumetric flows and 24 hour volumetric flows. Because of so many variables that impact on the economics of adding a gas expander be it with: a boiler, CHP or CCHP the current gas pipeline operators choose to pre-heat the gas by the use of boilers and or heaters. In all of the above practices, there is no attempt made to recover NGL's present in the natural gas stream at Metering and Pressure Reduction Stations. The typical practice is to have large facilities upstream in the transmission line known as Straddle Plants which recover a percentage of the NGL's for feedstock to the petrochemical industry.

SUMMARY OF THE INVENTION

According to the present invention there is provided a method to remove water present in the gas stream, produce NGL's, and then pre-heat the gas to meet pipeline specifications. This method recovers NGL's, removes water, and eliminates the present practice of using natural gas as a fuel for boilers, heaters, gas turbines, gas engines, or fuel cells to pre-heat the natural gas before pressure reduction. Moreover, the present invention provides the ability to recover most of the energy available for recovery at pressure reduction stations. A first step has at least one heat exchanger, with a first flow path for passage of incoming high pressure gas that indirectly exchanges heat with a counter current lower pressure cold gas stream. The low pressure cold gas stream flow can be controlled to meet desired temperatures in the high pressure gas stream through the use of a by-pass around the heat exchanger. The now cold high pressure gas enters a vessel separator, where water is removed. A second step involves passing the high pressure cold and water free gas stream through a gas expander, dropping the pressure to local distribution pipeline spec generating shaft work and a further drop in temperature. The shaft rotates a power generator producing electricity and the lower pressure colder gas enters a separator where NGL's are recovered. The objective is to control the temperature upstream of the gas expander to meet the desired NGL's recovery. The third step involves the use of the generated electricity as a heat source to the heat exchanger that controls the gas supply temperature to the local distribution pipeline. This eliminates the existing practice of combusting natural gas to pre-heat the gas to prevent the formation of hydrates. The fourth step involves the use of air exchangers to release part or all of the cold energy to the surroundings, this provides the ability to export electricity at warm atmospheric conditions.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTIONS OF A TYPICAL PRS AND THE PREFERRED EMBODIMENT

Figure 1:
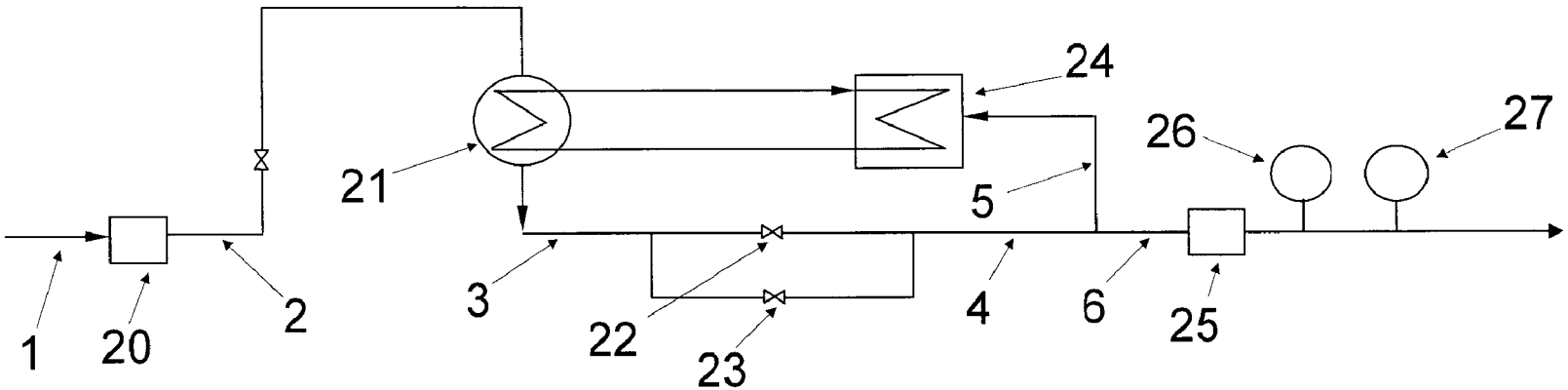
FIG. 1 (PRIOR ART)
FIG. 1 is a schematic diagram of a typical method to pre-heat gas at gas Pressure Reduction Stations (PRS) in the prior art.

The typical method that presently is used to pre-heat natural gas at Pressure Reduction Stations will now be described with reference to FIG. 1.

In this typical gas pre-heating process, gas enters a station via gas supply line 1. The gas stream enters filter 20 to remove any debris in the stream. The filtered gas exits the filter through line 2 and enters heat exchanger 21 for pre-heating. The heated gas exits through line 3 and the pressure is reduced at Pressure Reducing Valve (PRV) 22. A by-pass with PRV 23 is provided for service reliability, for scheduled and unscheduled maintenance. The PRV pressure is controlled by Pressure Transmitter (PT) 27 at a pre-set pressure. The low pressure controlled gas stream 4 feeds a gas slipstream 5 for combustion in a heater/boiler 24. The gas slipstream flow 5 is controlled by Temperature Controller (TC) 26 at a pre-set temperature. The gas stream 6 is metered at Flow Meter (FM) 25 and delivered to consumers.

The preferred embodiment will now be described with reference to FIG. 2. In the preferred embodiment, the gas enters a station through supply line 1. The high pressure gas stream enters filter 20 to remove any debris in the stream. The filtered gas exits filter 20 through gas line 2 and gas line 203 and passes through heater exchanger 51. At heater exchanger 51, the high pressure gas is cooled by the counter current depressurized gas stream to condense any water present in the high pressure gas stream. The cooled high pressure gas stream in line 205 is discharged into separator 52. The water exits through line 7 and the dried gas exits through line 206.

The high pressure gas is routed through line 9 to gas expander 54, producing shaft work and a drop in gas temperature. The shaft rotates power generator 55, producing electricity. The produced electricity is carried by electrical wires 223 to electrical heater 58. A bypass JT valve 53, supplied by line 8, is provided for startup and emergency services.

The low pressure cold gas in line 10 flows into separator 56 where NGL's are separated and recovered. The NGL's exit through line 11. The lean cold gas exits the separator through line 12 and can be routed through line 13 and line 15 to meet desired operations temperatures. The lean gas stream in line 13 enters an air exchanger 57 where the cold energy is dissipated into the atmosphere by natural draft, wherein the amount of cold energy dissipated to the atmosphere is dependent on the choice and objectives of the local plant. The lean stream exits air exchanger 57 through line 14 at near atmospheric temperatures. The warmer lean gas stream 14 can be blended through line 16 or line 18 to meet desired operations temperatures. The lean and cold gas stream in line 15 can be sent directly or blended with stream 16 and sent to heat exchanger 51 to cool in a counter current flow the incoming high pressure rich gas stream. The lean depressurized gas exits heat exchanger 51 through line 19 and blends with stream 18 into stream 220. The blended stream 220 enters line 204 and is routed to heater 58 to increase the lean gas temperature to local distribution pipeline specifications. The heat is supplied by the power generator 55 and transmitted through electrical wires 223 to the heating elements in heater 58. The heated lean gas in line 6 is measured in meter 25. A temperature controller 26 controls the heat supplied to heater 58. A pressure controller 27 controls the pressure to the local distribution pipeline 222.

Figure 2:
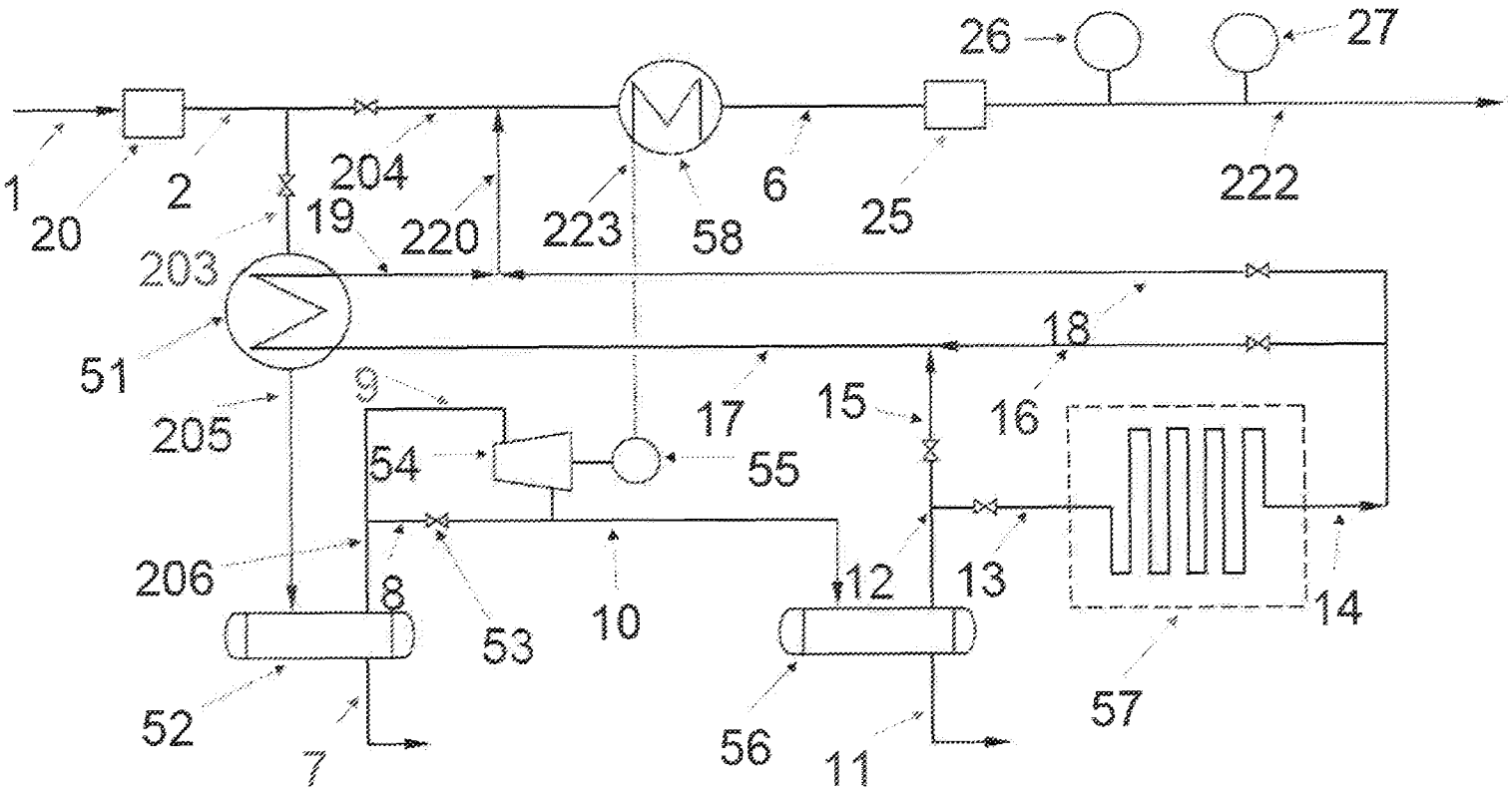
FIG. 2 is a schematic diagram that depicts the embodiment of the invention.
Figure 3:
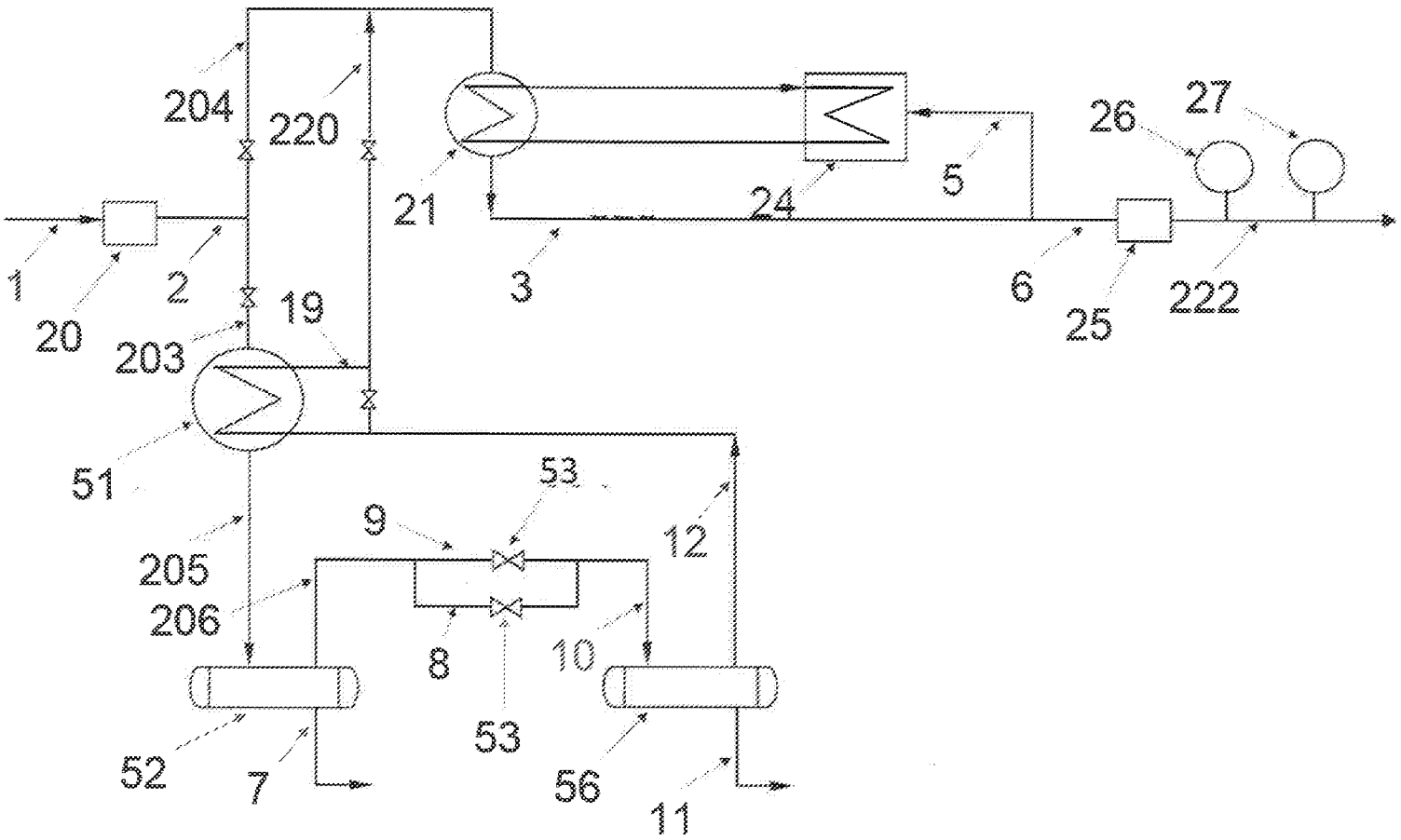
FIG. 3 is a variation on the embodiment of the invention.

A variation is depicted in FIG. 3, which shows stream 206 passing through a JT valve rather than through a gas expander as shown in FIG. 2. There is no power generation and no air/heat exchangers just NGL's recovery. Moreover, the cold temperatures generated by dropping the pressure through a JT valve will not be as cold as through the expander since no work is done.

Figure 4:
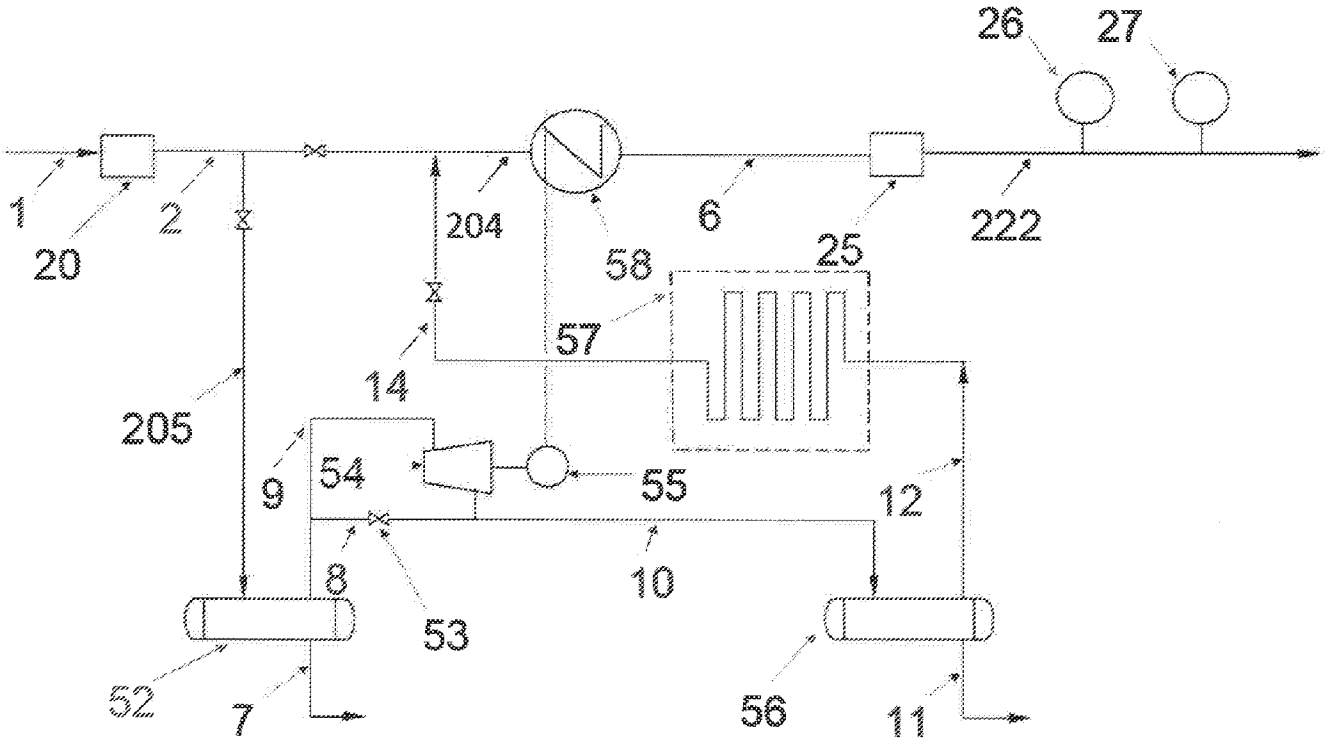
FIG. 4 is another variation on the embodiment of the invention.

A further variation is depicted in FIG. 4, which shows stream 203 going straight into separator 52, with no pre-cooling heat exchange upstream of this separator as in FIG. 2 and FIG. 3. The NGL's are recovered and separated in vessel 56 and removed through line 11. The lean gas flow 12 is pre-heated in a atmospheric air/heat exchanger.

Figure 5:
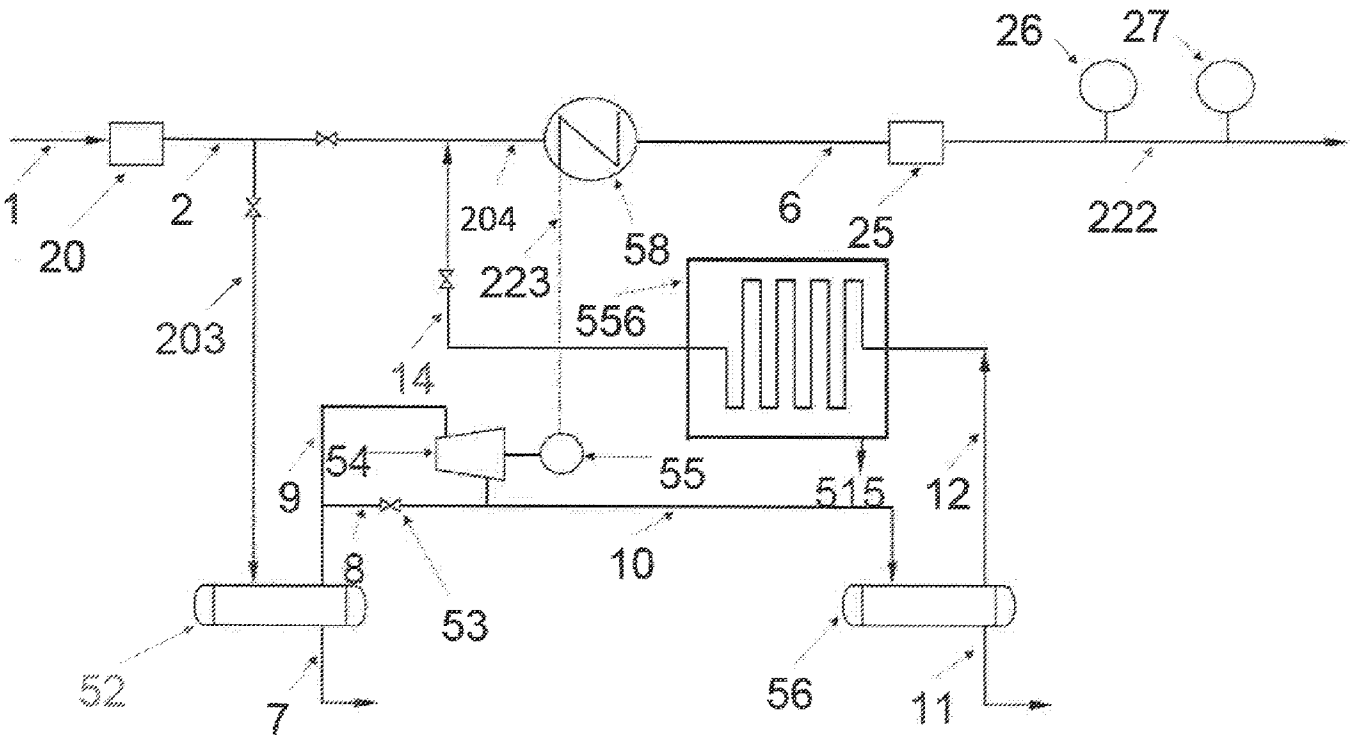
FIG. 5 is another variation of the embodiment of the invention to liquefy gases.

A further variation is depicted in FIG. 5, which shows the pre-heating exchanger 556 being through a waste heat stream 515. This stream could be hot water, steam, flue gases, etc.

The preferred embodiment in FIG. 2 has the advantage over the present practice in that it substantially reduces and or eliminates the use of a gas slipstream to pre-heat the gas prior to de-pressurization and recovers NGL's, a feedstock to the petrochemical industry. This is significant when one considers that it can replace existing PRV's (known in the industry as JT valves) and line heaters. Associated with it is the reduction or elimination of emissions presently generated in these line heaters. Moreover, the energy used to replace the slipstream gas is recovered energy (no new emissions generated) which presently is dissipated across a PRV.

What is claimed is:

1. A method to recover natural gas liquids (NGLs) at a pressure reduction station, comprising the steps of:

providing at least one heat exchanger, a gas expander, a first separator, and a second separator at the pressure reduction station where gas from a main transmission gas line is reduced in pressure from between 400 to 900 PSIG (pounds per square inch gage) to from 50 to 95 PSIG for distribution through local distribution lines, each separator having a single inlet and only two outlets, namely, a first outlet and a second outlet, each heat exchanger having a flow path for passage of a high pressure natural gas stream and a counter current passage for a depressurised cold lean gas stream;

removing water from the high pressure natural gas stream in order to prevent formation of hydrates by passing the high pressure natural gas stream, that has previously had a majority of the natural gas liquids removed during processing at a straddle plant, along the heat exchanger in order to cool the high pressure natural gas stream through a heat exchange with the depressurized cold lean gas stream before pressure reduction, and through the first separator such that water is condensed out of the high pressure natural gas stream and exits via the first outlet of the first separator;

passing all of the remainder of the high pressure natural gas stream exiting via the second outlet of the first separator, which has had water removed, through the gas expander to reduce pressure of the natural gas stream to a reduced pressure of between 50 and 95 PSIG so it is suitable for consumption by a downstream user;

passing the natural gas stream, which has been reduced in pressure to between 50 and 95 PSIG, through the second separator to produce a first stream of depressurized cold lean natural gas exiting through the first outlet of the second separator and a second stream of NGLs exiting through the second outlet of the second separator; and communicating the first stream exiting via the first outlet of the second separator at the reduced pressure of between 50 and 95 PSIG to the downstream user.

2. The method of claim 1, including a step of heating a portion of the first stream and then blending selected quantities of the heated portion of the first stream with selected quantities of an unheated portion of the first stream.

3. The method of claim 1, including a step of heating at least a portion of the first stream by passing the portion of the first stream through a heat exchanger.

4. The method of claim 3, including a step of heating at least a portion of the first stream by passing the portion of the first stream through a heat exchanger to effect a heat exchange with ambient outdoor air.

5. The method of claim 3, including a step of heating at least a portion of the first stream by passing the portion of the first stream through a heat exchanger having a counter current waste heat stream.

6. The method of claim 1, including a step of connecting the gas expander to a power generator and using the power generated to run heaters and heating at least a portion of the first stream with the heaters.

* * * * *